US006374469B1

(12) United States Patent
Baudry et al.

(10) Patent No.: US 6,374,469 B1
(45) Date of Patent: Apr. 23, 2002

(54) NEEDLING MACHINE PROVIDED WITH A DEVICE FOR MEASURING PENETRATION

(75) Inventors: Yvon Baudry, Merignac; Robert Jean, Fouqueville, both of (FR)

(73) Assignee: Messier-Bugatti, Velizy-Villacoublay (FR)

( * ) Notice: Subject to any disclaimer, the term of this patent is extended or adjusted under 35 U.S.C. 154(b) by 0 days.

(21) Appl. No.: 09/880,462

(22) Filed: Jun. 13, 2001

(51) Int. Cl.[7] ..... D04H 18/00
(52) U.S. Cl. ..... 28/107
(58) Field of Search ..... 28/107, 108, 109, 28/110, 111, 112, 113, 114, 115, 100, 103; 26/70; 73/159; 356/238.1, 238.2

(56) References Cited

U.S. PATENT DOCUMENTS

| | | | | | |
|---|---|---|---|---|---|
| 3,108,353 | A | * | 10/1963 | Rust, Jr. | 28/107 |
| 4,631,789 | A | * | 12/1986 | Dilo | 28/107 |
| 4,790,052 | A | * | 12/1988 | Olry | 28/118 |
| 4,891,870 | A | * | 1/1990 | Muller | 28/107 |
| 4,962,576 | A | * | 10/1990 | Minichshofer et al. | 28/110 |
| 5,226,217 | A | | 7/1993 | Olry et al. | |
| 5,349,728 | A | * | 9/1994 | Murakami et al. | 28/107 |
| 5,636,420 | A | * | 6/1997 | Jourde et al. | 28/107 |
| 5,737,821 | A | * | 4/1998 | Lawton et al. | 28/115 |
| 5,792,715 | A | * | 8/1998 | Duval et al. | 28/107 |
| 6,029,327 | A | | 2/2000 | Sheehan et al. | |
| 6,175,996 | B1 | * | 1/2001 | Gstrein et al. | 28/114 |

FOREIGN PATENT DOCUMENTS

| | | |
|---|---|---|
| FR | 2 741 634 | 5/1997 |
| GB | 1 308 999 | 3/1973 |
| GB | 1 449 641 | 9/1976 |
| JP | 11-012913 | 1/1999 |
| WO | WO 97/15708 | 5/1997 |

* cited by examiner

*Primary Examiner*—Amy B. Vanatta
(74) *Attorney, Agent, or Firm*—Weingarten, Schurgin, Gagnebin & Lebovici LLP

(57) ABSTRACT

A machine for needling a textile structure made up of a plurality of superposed layers comprises a vertically movable needling table, a needling head having a determined number of barbed needles and disposed vertically above the needling table, and drive means for imparting vertical reciprocating motion to the needling head, defining a low point of maximum penetration of the needles. Measuring means are provided in the machine located in the needling head to measure the position of the top surface of the textile structure at the low point of maximum penetration of the needles. The measuring means are preferably disposed in a midplane of the needling head perpendicular to an advance direction of the textile structure.

11 Claims, 3 Drawing Sheets

NEEDLING MACHINE PROVIDED WITH A DEVICE FOR MEASURING PENETRATION

FIELD OF THE INVENTION

The present invention relates to making needled textile structures for use in the manufacture of protective parts used at high temperatures, structural parts of rocket engines, or indeed very high performance brake disks for aviation or for terrestrial vehicles.

PRIOR ART

Brake disks need to withstand braking that creates particularly large shear forces. This phenomenon is accentuated in aircraft because of the large stresses applied to brake disks.

In order to withstand these shear forces that give rise to a delaminating effect, disks must be manufactured in such a manner as to minimize structural non-uniformities. A non-uniform disk has localized zones in which stress characteristics are heterogeneous, thereby considerably increasing the risk of tearing.

Conventionally, brake disks are made from a reinforcing textile structure made up of a plurality of superposed layers that are needled together by a set of barbed needles penetrating in a z direction, i.e. transversely relative to the layers. After being cut to size, the textile structure is carbonized, is then densified using a matrix-forming material, and is finally subjected to optional heat treatment. The layers are superposed on a support. A downward movement step is generally imparted to the support as the superposed layers build up, and needling is performed in the various layers. The mechanical characteristics of the final product obtained in this way depend very greatly on the real needling density used in the textile reinforcing structure. The term "real" needling density is a function of the number of needle barbs per cubic centimeter ($cm^3$) seen by an elementary volume of the textile structure, and therefore includes the needling density per unit area, the extend of z penetration, the size of the downward displacement step, and the functional characteristics of the needles.

Present-day needling methods make it difficult to obtain the desired perfect uniformity, even though some methods do provide good results, in particular by acting on the size of the downward step. Mention can be made of U.S. Pat. No. 4 790 052 which proposes that the distance between the needles and the layer support be increased for each superposed layer by a distance that is equal to the thickness of a needled layer. Mention can also be made of European patent No. 0 736 115 which seeks to obtain constant thickness for the various superposed layers by adopting displacement steps for the layer support that are of a size that reduces in compliance with a predetermined relationship.

The imperfection of those methods comes from the fact that the size of the downward displacement step for the layer support is generally calculated beforehand on theoretical grounds, in particular as a function of the number of layers that are to form the resulting textile structure, and no account is taken of the real penetration depth of the needles. Unfortunately, it is essential to know this parameter in order to guarantee uniform needling density which is a requirement for obtaining a final textile structure presenting good uniformity. In addition, the greater the thickness of the textile structure, the greater the margin of error concerning knowledge about penetration depth.

European patent application No. 0 695 823 seeks to improve knowledge of needle penetration depth by means of feeler rollers that measure the position of the top surface of the textile structure between needling operations and that are disposed beside the working zone for the needles.

Nevertheless, such a solution turns out to be unsatisfactory since under the action of needling forces, the textile structure is compressed in a way that the measurement performed does not detect. This failure to take account of the deformation of the textile structure means that it is not possible to have exact knowledge concerning the real penetration depth of the needles.

OBJECT AND DEFINITION OF THE INVENTION

The present invention thus proposes a needling machine and an associated method which mitigate this drawback by enabling the real penetration depth of needles in the textile structure for needling to be measured in such a manner as to take account of the deformation of the structure while performing the operations of needling the various layers that make it up.

This object is achieved by a machine for needling a textile structure made up of a plurality of superposed layers, the machine comprising a vertically movable needling table, a needling head having a determined number of barbed needles placed vertically above said needling table, and means for driving said needling head to impart vertical reciprocating motion thereto defining a low point of maximum needle penetration in said textile structure, the machine further comprising measuring means disposed in said needling head to measure the position of the top surface of said textile structure at the low point of maximum penetration of the needles.

Thus, by positioning the measuring means in the needle board it is possible to take account of the extent to which the textile structure is compressed under the effect of the needling forces, thereby making it possible to determine accurately the real penetration depth of the needles.

Preferably, said measuring means are disposed in a mid-plane of said needling head perpendicular to an advance direction of said textile structure.

In a preferred embodiment, said means for measuring the position of the top surface of said textile structure comprise an optical assembly for performing contactless measurements. Preferably, this comprises a broad beam type of laser emitter/receiver.

In an alternative embodiment, said measurement means can comprise a mechanical feeler for measuring by contact.

Advantageously, a sensor is provided, preferably of the inductive or optical type, to determine said low point of maximum needle penetration, and processor means are provided for controlling the vertical displacement of said needling table as a function of the position of the top surface of the textile structure as measured at said low point of maximum needle penetration by said measuring means.

The invention also provides a method of using the above-mentioned machine to make a textile structure, and to the textile structure obtained by the method. The position of the top surface of the textile structure is preferably measured by means of instantaneous measurements performed in real time over the entire length of the textile structure.

BRIEF DESCRIPTION OF THE DRAWINGS

The characteristics and advantages of the present invention will be seen more clearly on reading the following description given by way of non-limiting indication and with reference to the accompanying drawings, in which.

DETAILED DESCRIPTION OF PREFERRED EMBODIMENTS

Figure 1:
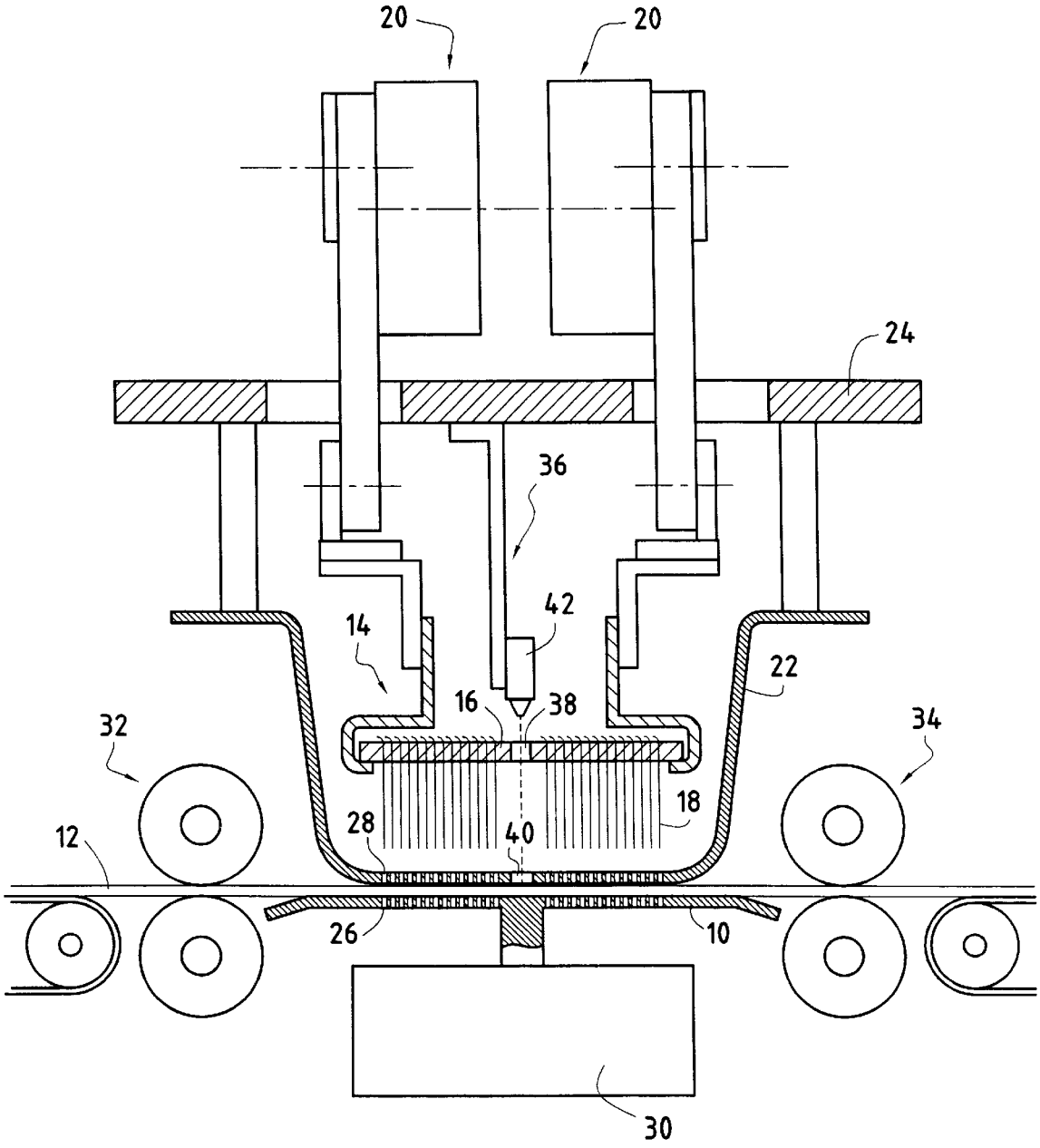
FIG. 1 is a diagrammatic view of a first embodiment of a machine of the invention for needling textile structures.
Figure 2:
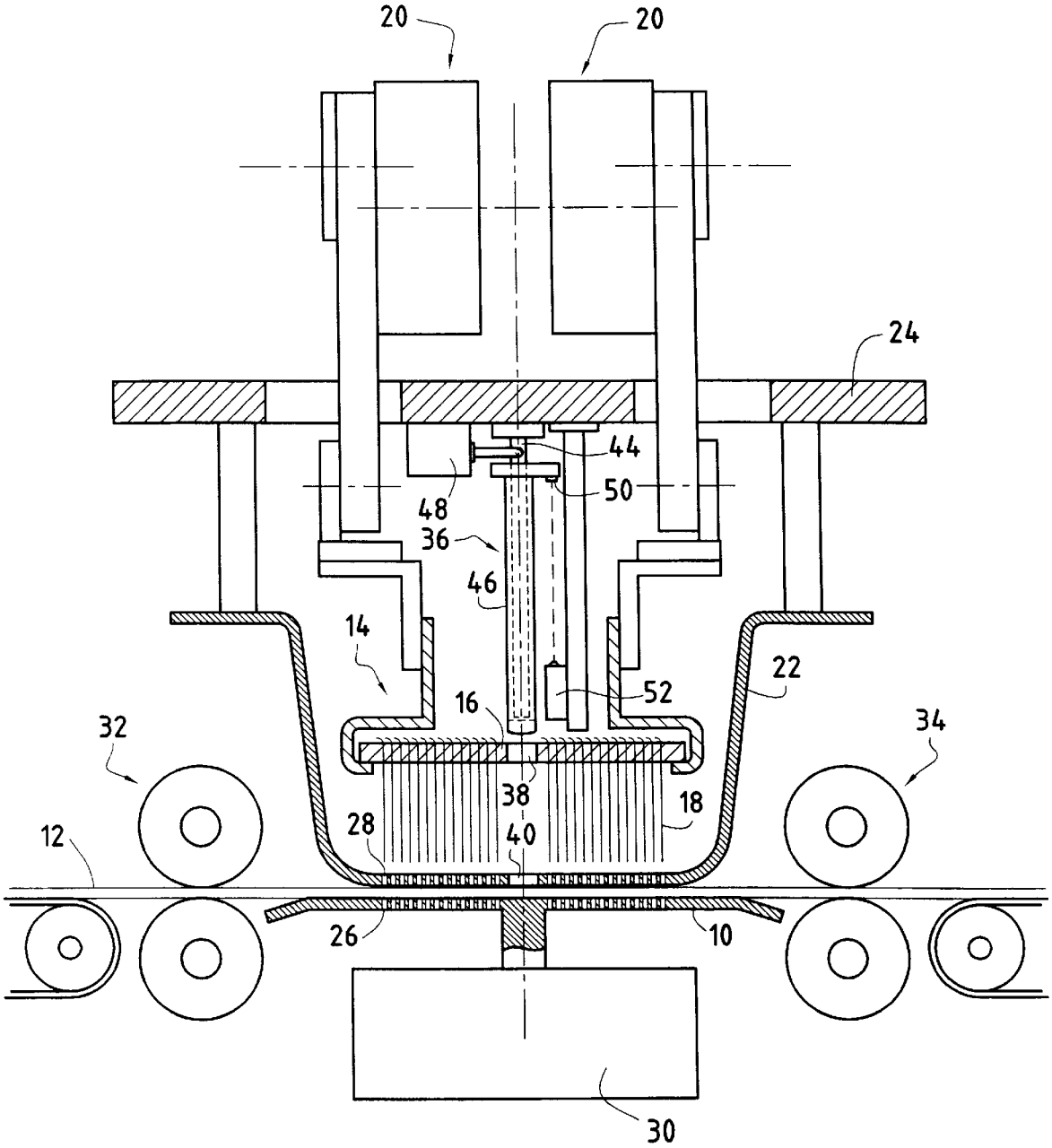
FIG. 2 is a diagrammatic view of a second embodiment of a machine of the invention for needling textile structures.

Two embodiments of a machine for needling a plane textile structure are shown in FIGS. 1 and 2. Naturally, it should be understood that the invention is not limited solely to making structures that are plane and that making a structure by winding a fiber sheet also constitutes an application of the present invention, whether the sheet or cloth is twisted annularly and helically to form flat superposed turns, or whether a sheet is rolled onto a mandrel to form superposed turns.

The machine conventionally comprises a "needling" table 10 for supporting layers or sheets 12 of length and width that are determined as a function of the final structure that is to be made, and that are fed one after another so as to be superposed in successive layers. The table is placed vertically beneath a needling head 14 which has a determined number of conventional barbed needles 18 mounted on a needle board 16, which head can be driven in vertical reciprocating motion by one or more crank assemblies 20 driven by one or more motors. A stripper 22 fixed to a frame 24 of the machine is mounted over the needling table to prevent the textile structure being entrained when the needles rise. Naturally, both the table and the stripper are pierced with respective holes 26, 28 for passing the needles. The table moves vertically under drive from a device 30, e.g. constituted by a motor-driven wormscrew. Two series of drive rollers 32, 34 (also known as inlet and outlet presses) placed upstream and downstream from the machine serves to convey the textile structure horizontally towards the needling head.

The invention provides means 36 for measuring the position of the top surface of the textile structure and located in the needling head 14 so as to determine the real penetration depth of the needles in the textile structure, at a low point of maximum needle penetration. Since the stroke of the needles is constant relative to the frame to which they are connected and since the needling table is positioned at a known distance relative to the frame, it can be easily be shown that the depth to which the needles penetrate into the textile material depends directly on the thickness of material existing between the needling table and the measured top surface.

For this purpose, the measuring means 36 are fixed to the frame 24 and the needling board 16 (and the stripper 22) are pierced by respective orifices 38 and 40 for enabling the measuring means to co-operate with the top surface of the textile structure.

In the embodiment shown, this co-operation can take place without contact (with the position of the top surface of the textile structure being measured remotely) or with contact (by lowering a mechanical feeler onto the top surface of the textile structure).

FIG. 1 shows a preferred embodiment of the invention in which the contactless measuring means are constituted by an optical measuring assembly such as a laser emitter/receiver 42. The emitter sends a laser beam through the needle board and the stripper towards the top surface of the textile structure which then reflects the beam back to the receiver. The distance between the emitter and the needling table is assumed to be known by prior measurement, so the distance between the emitter and the top surface of the textile structure can be determined by analyzing the go-and-return path of the laser beam, and it then suffices to evaluate accurately the thickness of the textile structure supported by the needling table. In addition, to avoid difficulties with defects in relief on the textile structure, the laser assembly is preferably of the broad beam type (since this type of laser performs an integration effect by measuring over the entire width of the beam). Naturally, it is quite possible to use an optical measuring assembly that operates in the infrared, without infrared necessarily being preferred.

FIG. 2 shows an alternative embodiment in which the measuring means are constituted by a mechanical feeler formed by an internal piston 44 fixed to the frame 24 and on which an outer sleeve 46 is slidably mounted, the sleeve having a slightly rounded end intended to come into contact directly with the textile structure (after passing through the needle board and the stripper). This sliding of the sleeve is driven by controlled injection of a fluid, preferably compressed air, into the piston from a control module 48 which is fixed to the frame 24. The pressure of the fluid is adjusted as a function of the nature of the textile structure to be needled (hardness, rebound reaction), and it is adjusted so as to ensure that the sleeve does not bounce on said textile structure. The sleeve also includes a reflecting collar 50 at its top end for cooperating with an optical measuring assembly such as a laser or infrared emitter/receiver 52 that is likewise fixed to the frame. The emitter directs its beam at the collar on the sleeve which then reflects it to the receiver. When the end of the feeler is in contact with the needling table, the distance between the emitter and the receiver is assumed to be known by prior measurement, so determining the distance between the emitter and the receiver when said end is in contact with the top surface of the textile structure (by analyzing the go-and-return path of the beam) suffices in this case also to enable the thickness of the textile structure carried by the needling table to be evaluated accurately.

Figure 3:
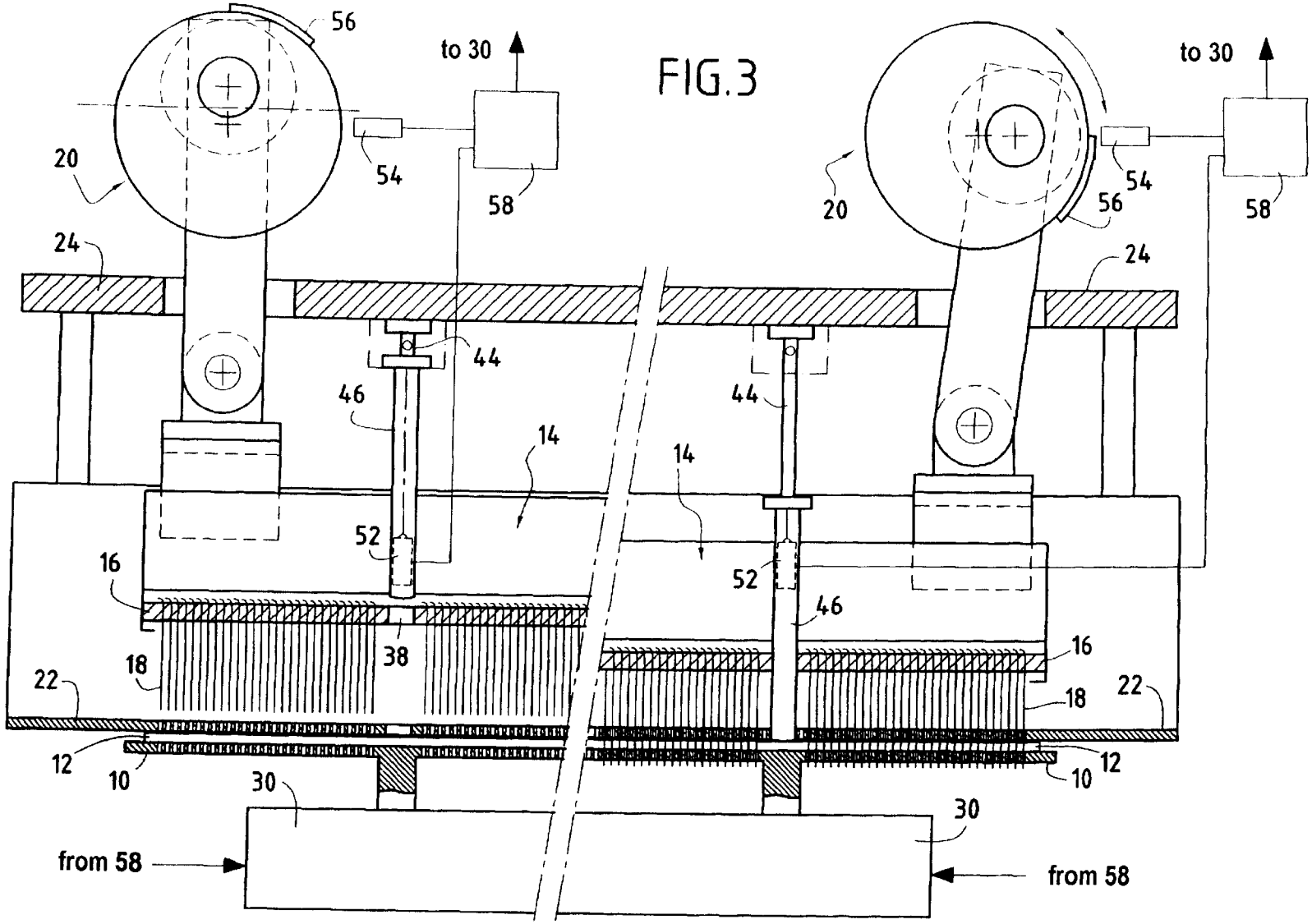
FIG. 3 is a side view of the FIG. 2 machine, with its right-hand portion being shown in a position of maximum needle penetration.

In both of the above-described embodiments, the measuring means 36 are preferably disposed in a midplane of the needling head 14 perpendicular to the direction in which the textile structure advances (although naturally it is possible to depart significantly therefrom). The measuring means can be duplicated if the textile structure is in the form of two adjacent plates advancing parallel to each other beneath the needling head. In this configuration as shown in FIG. 3, the needling head can comprise two independent needle boards placed side by side, with the measuring means then being placed substantially in the center of each board. To facilitate understanding, FIG. 3 shows the machine in the context of the above alternative embodiment in two distinct positions, one of the positions (left-hand half of FIG. 3) corresponding to a rest position with the needling head raised, and the other (right-hand portion) corresponding to a position of said head at its low point of maximum needle penetration.

The low point of maximum needle penetration is determined in real time by a sensor 54, e.g. of the inductive or optical type, which sensor is secured to the frame and co-operates, for example, with a specific cam profile 56 on the crank assembly 20 for controlling the vertical reciprocating motion of the needling head. This cam profile serves to determine a period of time (and not merely a single and instantaneous measurement instant) during the downstroke of the needle board, preferably close to the low point, during which the measurement means 36 are active and can acquire a plurality of measurements, from which a processor module 58 connected both to the sensor 54 and to the measuring means 36 can determine a first mean value for the thickness of the needled layers. These measurements are subsequently reiterated after each horizontal advance step of the textile structure, and the set of values obtained at the end of a given pass serve to determine the real mean penetration depth of the needles, on the basis of which the device 30 for driving the needling table and connected to the processor means 58 can automatically cause the needling table to move vertically so as to receive the following pass, with the size of the downward step of the table being controlled so that the needles penetrate a determined distance into the textile structure.

Thus, the needling method implemented in the machine of the invention can be summarized as follows. Initially, a second layer thickness is superposed on a first layer thickness placed on the needling table and the two layers as superposed in this way are bonded together by the barbed needles of a needling head under predetermined conditions. Thereafter the needling table is moved relative to the needling head by a displacement step of size which is determined as a function of the position of the top surface of the two superposed layers as measured at the low point of maximum needle penetration by appropriate measurement means. Finally a third layer thickness is superposed on the two preceding layer thicknesses and said third layer thickness is bonded to the two preceding thicknesses under the same predetermined conditions. These steps are then repeated for the following layers until the textile structure has been built up to the desired thickness.

The method implemented in the above-described machines consists initially in placing one or two superposed layers on the table 10, which layers are then bonded together by needling using the needle board 16 while being moved horizontally over the entire length of the textile structure by advance rollers 32, 34. The table is then lowered by a displacement step of determined size so that a third layer can be superposed and in turn be needled to the other two layers and so on until the desired thickness is obtained.

In the invention, this displacement step of determined size is not of fixed size nor is it subject to a predetermined descent relationship, but is determined from the real penetration depth of the needles in the preceding layers of the textile structure as measured at the low point of maximum needle penetration so as to obtain a desired real density of needling in said textile structure, which density can be constant or can vary through the thickness of the textile structure. Thus, the position of the top surface of said textile structure is measured in the middle of the needles so as to generate the size of the downward step of the needling table in such a manner as to cause the needles to penetrate into the textile structure by a determined distance.

What is claimed is:

1. A machine for needling a textile structure made up of a plurality of superposed layers, the machine comprising a vertically movable needling table, a needling head having a determined number of barbed needles placed vertically above said needling table, and means for driving said needling head to impart vertical reciprocating motion thereto defining a low point of maximum needle penetration in said textile structure, the machine further comprising measuring means disposed in said needling head to measure the position of the top surface of said textile structure at the low point of maximum penetration of the needles.

2. A machine according to claim 1, wherein said measuring means are disposed in a midplane of said needling head perpendicular to an advance direction of said textile structure.

3. A machine according to claim 1, wherein said means for measuring the position of the top surface of said textile structure comprise an optical assembly for performing contactless measurements.

4. A machine according to claim 3, wherein said optical assembly comprises a laser emitter/receiver.

5. A machine according to claim 4, wherein said laser emitter/receiver is of the broad beam type.

6. A machine according to claim 1, wherein said means for measuring the position of the top surface of said textile structure comprise a mechanical feeler for measuring by contact.

7. A machine according to claim 1, further comprising a sensor preferably of the inductive or optical type, for determining said low point of maximum penetration of the needles.

8. A machine according to claim 7, further comprising processor means for controlling the vertical displacement of said needling table as a function of the position of the top surface of the textile structure as measured by said measuring means at the low point of maximum penetration of the needles.

9. A method of making a textile structure made up of a plurality of superposed layers, the method comprising the following steps:

a) superposing a second layer thickness on a first layer thickness placed on a needling table;

b) using the barbed needles of a needling head to connect together, under predetermined conditions, the thicknesses of the two layers superposed in this way;

c) displacing said needling table relative to said needling head through a displacement step of size determined as a function of the position of the top surface of the two superposed layers, said position being measured in the needling head at a low point of maximum penetration of the needles;

d) superposing a new layer thickness on the preceding layer thicknesses;

e) connecting said new layer thickness on the preceding layer thicknesses under said predetermined conditions; and f) repeating steps c), d), and e) for subsequent layer thicknesses, the displacement in step c) being determined as a function of the position of the top surface of the textile structure that is being built up and as measured in the needling head and at the low point of maximum penetration of the needles.

10. A method according to claim 9, wherein said position of the top surface of the textile structure is measured by averaging instantaneous measurements taken in real time over the entire length of the textile structure.

11. A textile structure formed by a plurality of superposed layers obtained by the method of claim 9.

* * * * *

UNITED STATES PATENT AND TRADEMARK OFFICE

CERTIFICATE OF CORRECTION

PATENT NO. : 6,374,469 B1
DATED : April 23, 2002
INVENTOR(S) : Yvan Baudry et al.

It is certified that error appears in the above-identified patent and that said Letters Patent is hereby corrected as shown below:

Title page,
Item [75], Inventors, "Yvon Baudry" should read -- Yvan Baudry --; and
Item [56], please insert the following priority information:
-- Foreign Application Priority Data
March 2, 2001 France ..... 0102869 --.

Signed and Sealed this

Fourth Day of November, 2003

JAMES E. ROGAN
*Director of the United States Patent and Trademark Office*